US012752175B2

(12) United States Patent
Vesely et al.

(10) Patent No.: US 12,752,175 B2
(45) Date of Patent: Oct. 6, 2026

(54) MOUTHGUARD WITH HYDRATION SYSTEM

(71) Applicants: Alexander Kang Vesely, Darnestown, MD (US); Ivan Vesely, Darnestown, MD (US)

(72) Inventors: Alexander Kang Vesely, Darnestown, MD (US); Ivan Vesely, Darnestown, MD (US)

( * ) Notice: Subject to any disclaimer, the term of this patent is extended or adjusted under 35 U.S.C. 154(b) by 179 days.

(21) Appl. No.: 18/599,974

(22) Filed: Mar. 8, 2024

(65) Prior Publication Data

US 2024/0299832 A1 Sep. 12, 2024

Related U.S. Application Data

(60) Provisional application No. 63/451,599, filed on Mar. 12, 2023.

(51) Int. Cl.

| | |
|---|---|
| ***A63B 71/08*** | (2006.01) |
| ***A45F 3/18*** | (2006.01) |
| ***A63B 102/24*** | (2015.01) |

(52) U.S. Cl.

CPC ..... *A63B 71/085* (2013.01); *A45F 3/18* (2013.01); *A63B 2071/088* (2013.01); *A63B 2102/24* (2015.10)

(58) Field of Classification Search

CPC ..... A63B 71/085; A63B 2071/088; A63B 2102/24; A63B 71/0036; A45F 3/18

See application file for complete search history.

(56) References Cited

U.S. PATENT DOCUMENTS

| | | | | |
|---|---|---|---|---|
| 5,342,313 | A * | 8/1994 | Campbell | A61M 5/16854 604/153 |
| 9,687,722 | B2 | 6/2017 | Kennedy | |
| 2005/0029319 | A1* | 2/2005 | Robins | A45F 3/20 224/148.2 |
| 2008/0308578 | A1* | 12/2008 | Skillern | A45F 3/20 224/148.2 |
| 2023/0241485 | A1* | 8/2023 | Peay | A63B 71/085 128/861 |

* cited by examiner

*Primary Examiner* — Donnell A Long

(74) *Attorney, Agent, or Firm* — RENNER, OTTO, BOISSELLE & SKLAR

(57) ABSTRACT

A mouthguard with a hydration system that combines protection to the users mouth and teeth, with a simple way to drink liquids while engaged in physical sports. The system comprises a mouthguard with a valve, a pressurized canister of fluid, and a tube that connects them together. The normally closed valve holds back the pressurized fluid, and is opened by the user with a push of their tongue. This enables the user to drink while engaged in heavy sports activity, such as ice hockey.

4 Claims, 9 Drawing Sheets

MOUTHGUARD WITH HYDRATION SYSTEM

RELATED APPLICATIONS

This application claims the benefit of U.S. Provisional Application No. 63/451,599, filed Mar. 12, 2023, which is hereby fully incorporated herein by reference.

FIELD OF THE INVENTION

The present invention relates generally to the field of sports equipment for protecting the teeth from injury, that also has a means for delivery of hydration fluids to the mouth.

BACKGROUND OF THE INVENTION

There are a number of physical activities that require protection of the teeth from impact, such as ice hockey, soccer and football. Participants in these sports most often wear mouth guards to protect their teeth, and also to avoid biting their tongue.

Because these activities demand considerable exertion, the players need to take frequent breaks to drink water. This can be done only when the player is on the bench during a break.

The current standardized mouthpieces/bite valves attached to water bladder tubes are not intended to remain in the user's mouth all the time. They are simple to lose from the user's mouth, distracting, and people usually stop using them while exercising.

In the case of ice hockey, players wear face shields and bulky gloves, and cannot quickly manage their fluid intake. To take a simple drink they need to (i) spit out their mouthguard, (ii) locate their water bottle and take a drink, (iii) take off their glove, (iv) lift up their shield, (v) take the drink, (vi) put the mouthguard back in their mouth with their free hand, (vii) close their shield, and (vii) put their glove back on.

The above sequence of steps cannot be done quickly. Young players often lose their bottles or cannot put their mouthguard back in their mouth before being called back to the ice. The simple process of taking a vital drink during a hockey game risks injury if the mouthguard cannot be quickly replaced back in the mouth when the player is called back to ice.

It would therefore be advantageous to combine the mouthguard with a fluid reservoir system that would enable the player to carry some fluids with them during play and hydrate as necessary.

U.S. Pat. No. 9,687,722 issued to Kennedy discloses a hydration mouthpiece that combines the mouthguard with a valve that can be closed when the user bites down on the mouthguard. It is also fitted with an intake tube that is intended to be connected to a water reservoir fitted with a bladder to pressurize the fluid.

This invention has a number of drawbacks. Firstly, it requires that the wearer bites down on the mouthguard in order to close the valve. Those that wear mouth guards during sport will recognize immediately that this is not a workable solution.

Firstly, mouthguard wearers do not apply continuous bite force to their guards. They clench and unclench their jaws periodically and move the guard back and forth between their teeth. Clenching their teeth for long periods to maintain the valve closed would quickly lead to jaw pain.

Secondly, hockey players often shout at each other during the game to identify their location. This cannot be done with their teeth clenched Thirdly, hockey players instinctively shout in excitement when a goal is scored. It would thus be very dangerous if water is injected into the player's mouth during such periods of excited shouting, as the players would not be prepared for the rush of water. The water could be aspirated and could lead to unpleasant lung complications.

The invention of Kennedy is therefore unworkable in practice, and accordingly has not been implemented in the marketplace. For safety of use, the valve needs to be closed all the time and opened only when specifically directed by the user, not randomly by moving the teeth.

The present invention discloses a mouthguard with a valve that is closed and can be opened by the tongue, thus allowing pressurized fluid to enter the mouth. Once the tongue is released from the valve, the fluid automatically stops flowing and the tongue can be used to aid in swallowing. Bite of the teeth against the mouthguard has no effect on the function of the valve.

SUMMARY OF THE INVENTION

The invention comprises a mouthguard protective component connected via a tubular portion to a pressurized fluid reservoir. The mouthguard protective component includes a valve that is normally closed, preventing fluid passage from the fluid reservoir to the mouth, and can be opened via directed pressure of the tongue against a portion of the mouthguard protective portion.

The invention described above allows the user to safely place the mouthguard in their mouth, move it around with their teeth, and vocalize as may be necessary during the activity without concern for accidentally initiating the flow of fluid into the mouth. The combination of a mouthguard protective portion connected to a fluid reservoir enables the user to hydrate as necessary during the game and without the need to remove equipment. The use of a pressurized fluid reservoir enables effort free delivery of fluid into the mouth without the need for potentially exhausting suction during intense activity and rapid breathing.

This Summary is provided to introduce a number of concepts in a simplified form that are described below in the Detailed Description section. This Summary is not intended to identify key features or essential features of the subject matter claimed, nor is it intended to be used to limit the scope of the subject matter claimed. A more extensive presentation of the features, details and advantages of the present invention as defined in the claims is provided in the following written description of the various embodiments of the invention and illustrated in the accompanying drawings.

DETAILED DESCRIPTION OF THE INVENTION

A Mouthguard with Hydration System is disclosed herein in conjunction with the accompanying figures.

The Mouthguard with Hydration System is comprised of a mouthguard protective component having an integral valve operated by the tongue, a pressurized fluid reservoir, and a flexible tube portion for providing fluid communication between the protective component and the fluid reservoir. In the illustrated embodiments of the present invention described herein, the fluid reservoir takes the form of a fluid container (deformable or rigid) or a fluid bag. Fluids stored in the reservoir may include, but are not limited to, water and sports drinks containing electrolytes.

The mouthguard protective component is preferentially fabricated from medical grade silicone rubber with a hardness appropriate for the application. It is shaped to fit between the teeth and can be of several sizes to accommodate users of different ages. It includes a spring component that keeps the valve closed until it is pressed upon by the tongue.

Throughout this specification, like reference numbers signify the same elements throughout the description of the figures.

Figure 6:
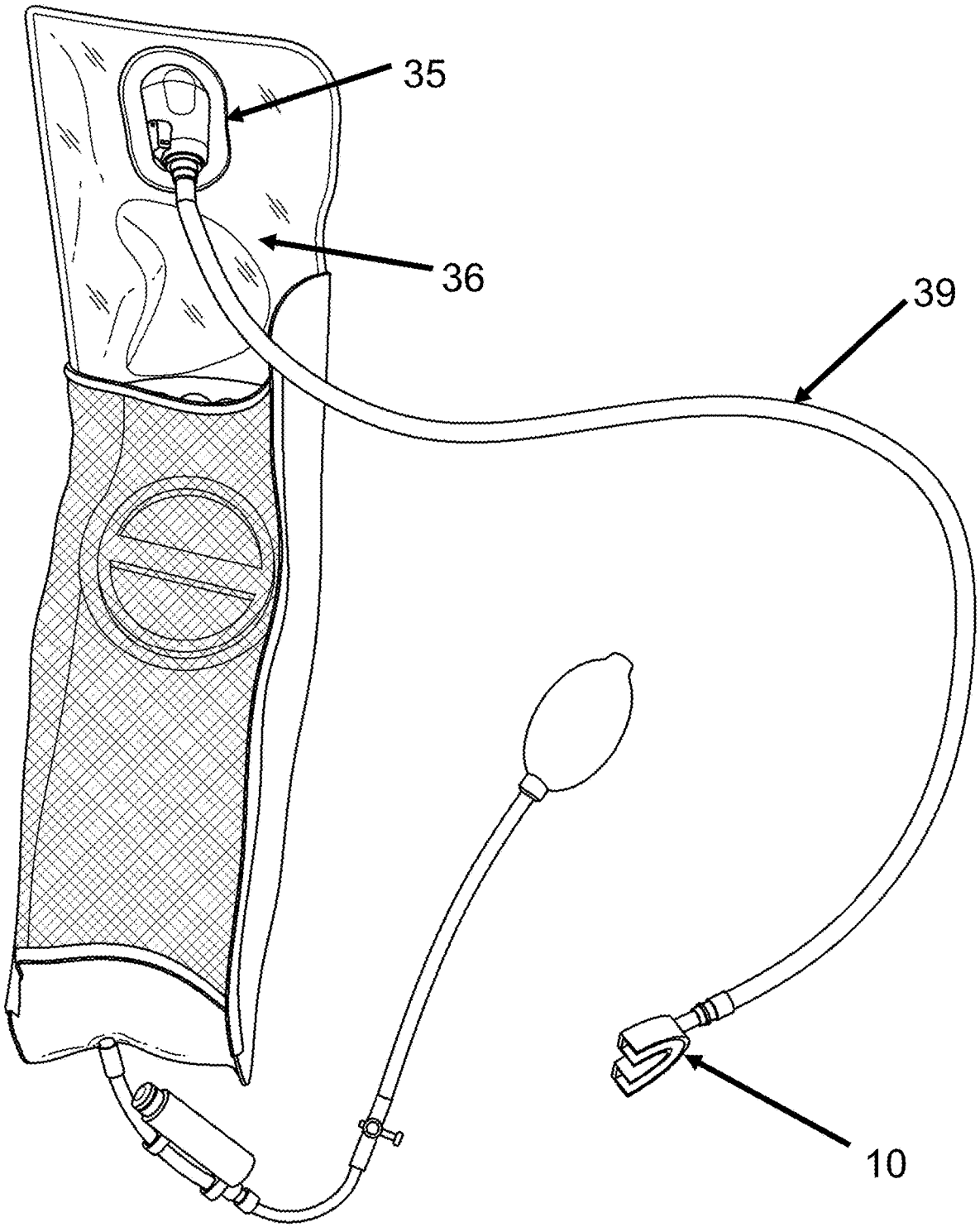
FIG. 6 is an overall view of the mouthguard connected to the fluid container via a flexible tube.

According to a first embodiment of the invention, as shown in FIGS. 1A, 1B, 2A and 2B, a mouthguard protective component 10 comprised of a rubber component 11 having a groove 12 to accept the top teeth, a flat portion 13 against which the bottom teeth rest, and a front plate 14 which protects the front teeth against injury. Mouthguard protective component includes an arc shaped spring 18 that keeps a valve 20 closed. A fluid handling component is comprised of a hollow tubular portion 15 that accepts a connector or fitting 16 that enables connection to a delivery tube 39 (See FIG. 6). Rubber component 11, groove 12, and front plate 14 collectively form a mouthpiece element.

Figure 3A:
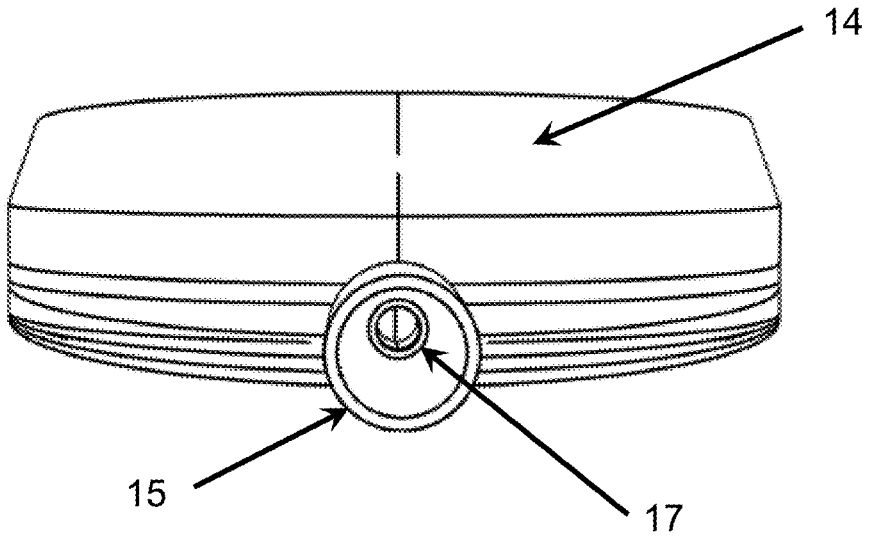
FIG. 3A is a drawing of the mouthguard component from the front.
Figure 3B:
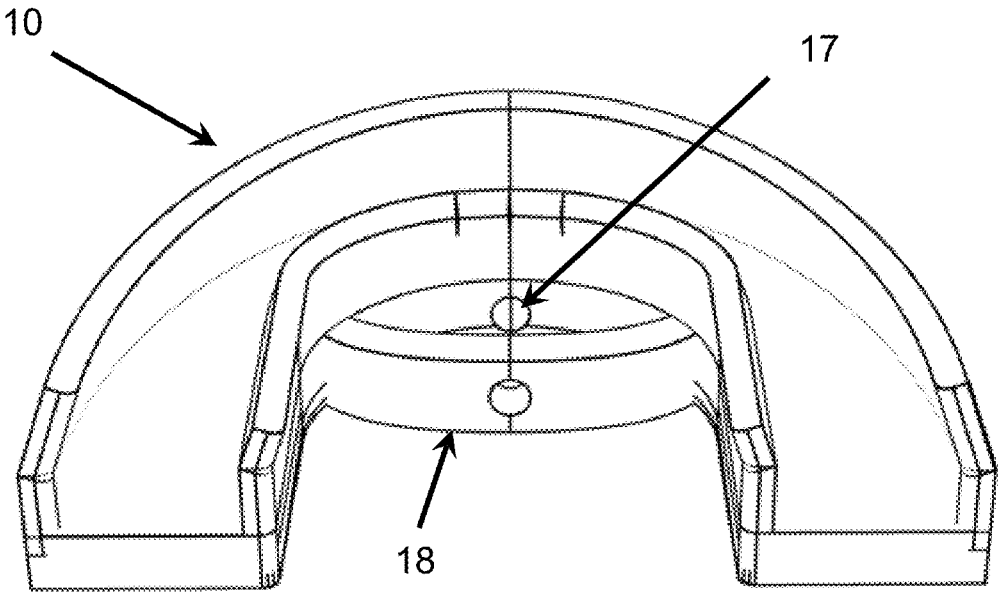
FIG. 3B is a drawing of the mouthguard component in perspective from the back.

The internal fluid handling passage are shown in FIGS. 3A and 3B. The tubular portion 15 shown in the front view of FIG. 3A has a central hole 17 that enables fluid to pass from the exterior of the mouthguard to the interior. This is shown from the back or inside view as shown in FIG. 3B.

Figure 4A:
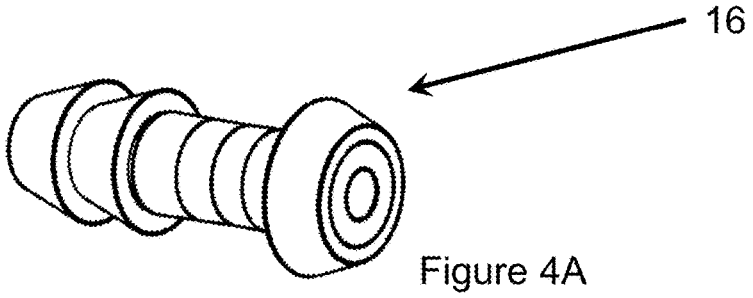
FIG. 4A is a perspective view of the fitting.
Figure 4B:
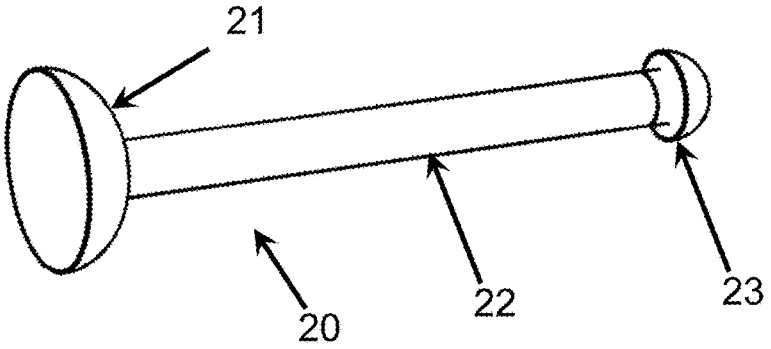
FIG. 4B is a drawing of the valve component internal to the mouthguard.

Valve 20 is shown in FIG. 4B. Valve 20 has a generally hemispherical occluder component 21 (domed portion), an elongated shaft component 22, and a dome shaped retaining element 23 so that it remains affixed to the spring 18 (best shown in FIG. 1A).

Figure 1A:
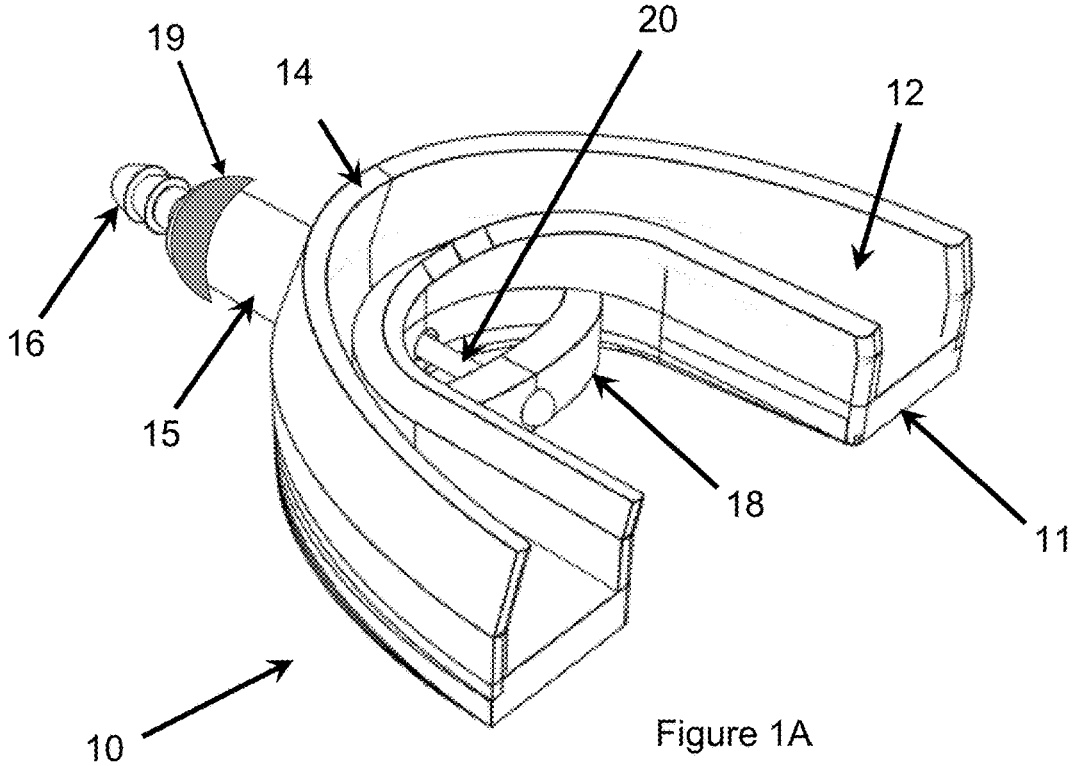
FIG. 1A is a drawing of the mouthguard component in perspective view from the top.
Figure 1B:
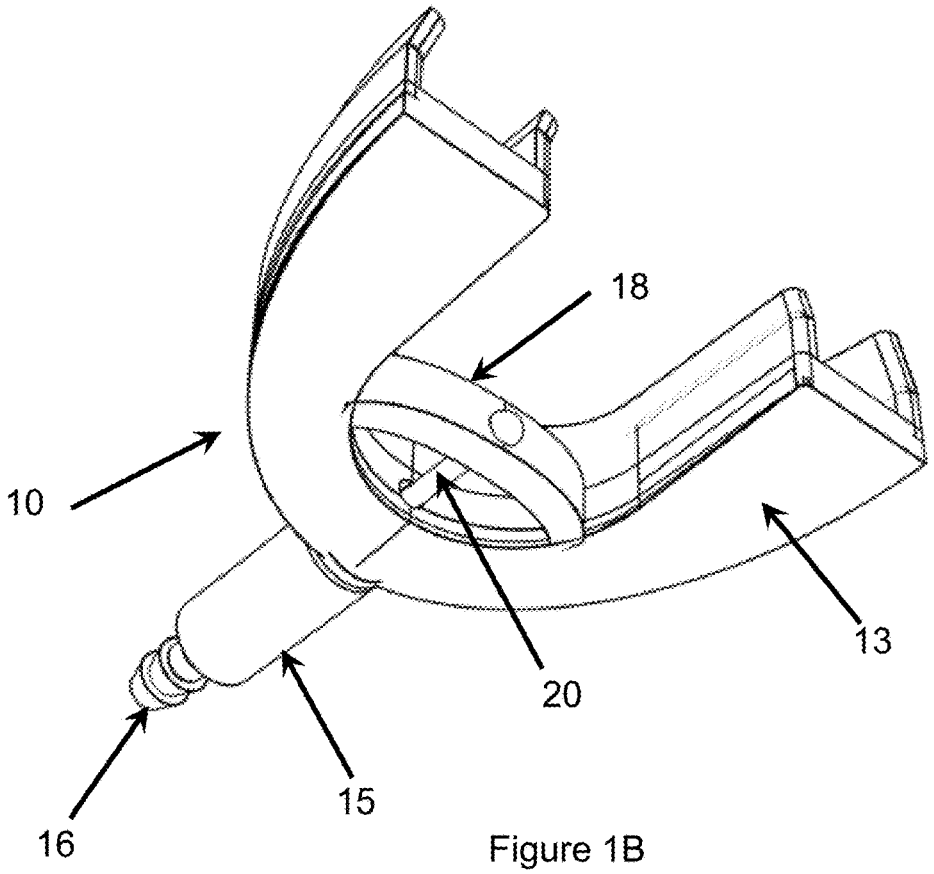
FIG. 1B is a drawing of the mouthguard component in perspective view from the bottom.
Figure 2A:
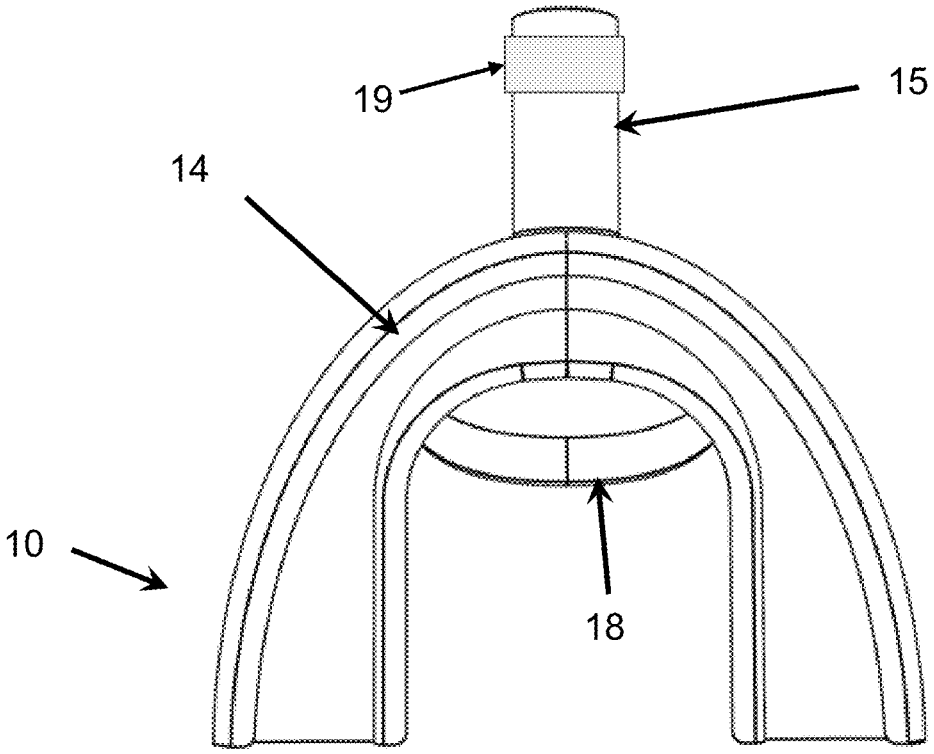
FIG. 2A is a drawing of the mouthguard component from the top.
Figure 2B:
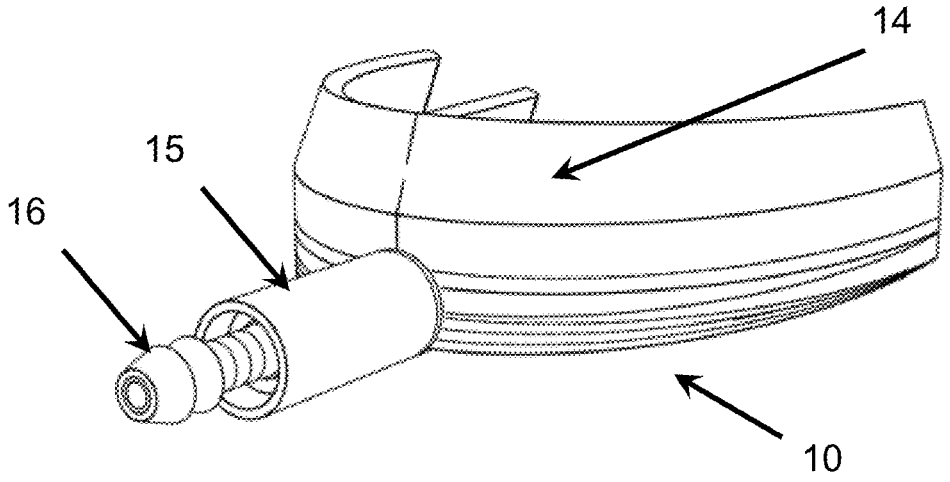
FIG. 2B is a drawing of the mouthguard component in perspective view from the front, showing the fitting used to connect to the mouthguard to the tube from the reservoir.

Referring to FIGS. 1A and 1B, mouthguard protective component 10 of the illustrated embodiment has a shape that is able to fit comfortably in the user's mouth. The flexible walls 12, 13, and 14 hold or cradle the teeth in a position that then allows the user to push on the spring 18 with their tongue, releasing the flow of water which is then swallowed. Mouthguard protective component 10 is preferably molded from a soft, compliant substance such as medical grade silicone rubber. Connector 16 and valve 20 (see FIGS. 4A-4C) are created from a hard plastic, or other rigid materials, via injection molding or similar process.

The ribbed connector 16 is sized to fit into the tubular portion 15 which is at the front of mouthguard protective component 10. The opposite end of the connector 16 fits into the delivery tube 39 which delivers pressurized fluid from deformable storage container 36 (see FIG. 6) or a rigid storage container 30 (see FIG. 7). Watertight connections are assured by proper sizing of the two ends of the ribbed connector 16 within the tubular portion 15 of mouthguard protective component 10, and within the delivery tube 39.

Figure 4C:
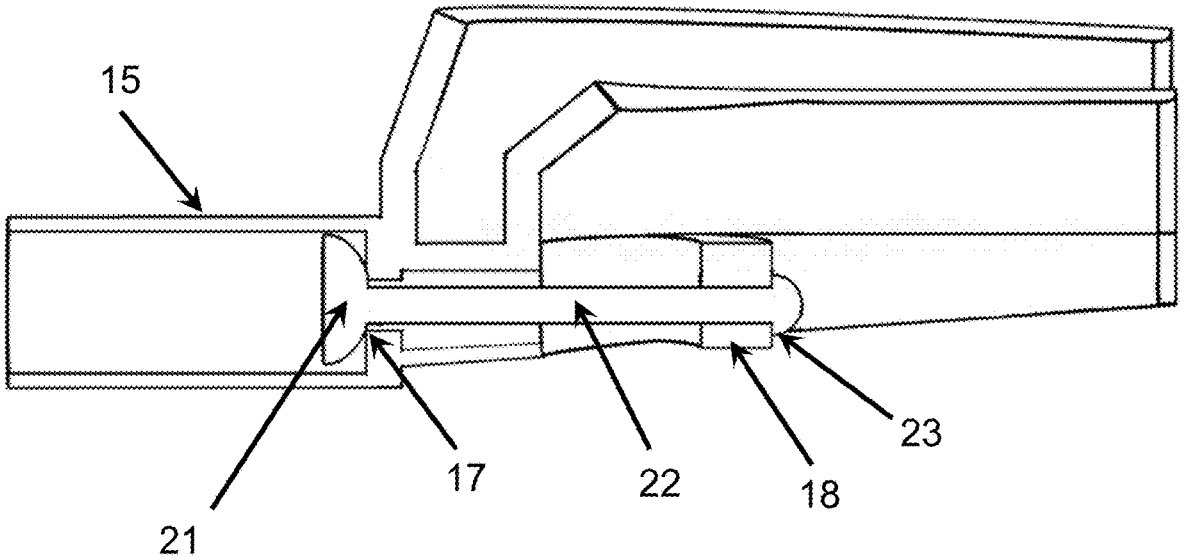
FIG. 4C is a cutaway of the mouthguard showing the position of the valve inside the tube component.

Referring to FIGS. 4B and 4C, the domed portion 21 of the plunger valve 20 creates a large enough seal with hole 17 formed in the body of mouthguard protective component 10, so that it can hold back the pressure of the supplied fluid and prevents any undesired leaks of fluid into the mouth, until the spring 18 is depressed.

The valve 20 is kept closed by firm contact between the domed portion 21 and the rim of the hole 17 by the force of the pressurized fluid applied on the back face of the domed portion 21, as well as by the elastic preload bias of the arc-shaped spring 18. The resting state of the system is such that spring 18 is preloaded slightly to pull the domed portion 21 against the rim of hole 17, thus maintaining a fluid seal. Pressure applied by the user's tongue in a forward direction against the spring 18 is required to unseat the rounded portion 21 from the rim of the hole 17, and thus, enable pressurized fluid to pass around the valve 20 into the mouth of the user.

Mouthguard protective component 10 according to the present invention is both hands-free, as no action by the user's hands is required to enable the release of the fluid, as well as free-standing, in that no action by the user is required to prevent water from passing into the user's mouth. This is in stark contrast to the invention of Kennedy (U.S. Pat. No. 9,687,722) which requires the user to continually clench teeth against a valve in order to prevent water from passing into the user's mouth. In the present invention, water cannot enter the user's mouth unless the user's tongue is pressed against spring 18 with sufficient force to overcome the force on the closed valve and open it. This is inherently a safe system.

Pressurized fluid is passed through delivery tube 39 to valve 20 via the ribbed connector 16 that connects to tubular portion 15.

Additional measures can be used to secure the ribbed connector 16 within the tubular portion 15. For example, an additional clamping ring 19 (see FIGS. 1A and 2A) can be applied over the tubular portion 15 to create a stronger seal against the ribbed connector 16.

Figure 7:
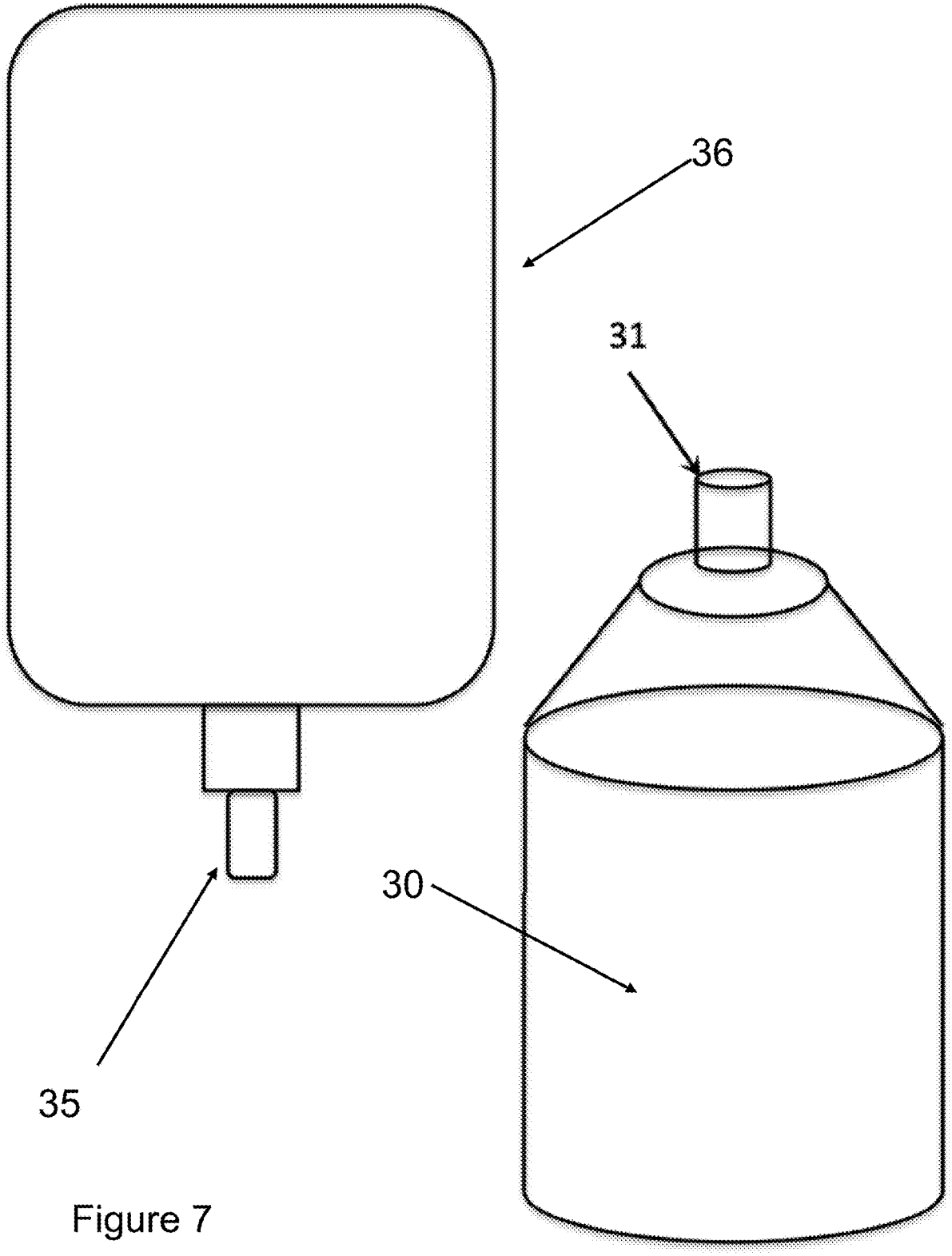
FIG. 7 are plan and perspective views of the rigid canister that holds pressurized air and water.

Delivery tube 39 connects to either a pressurized container 30 (FIG. 7) or pressurized bag 36 (FIG. 6) via an appropriate bag adaptor 35 (FIG. 7) or container adaptor 31 (FIG. 7).

The pressurized container 30 or the pressurized bag 36 are preferably under a pressure that is sufficient to deliver the flow of fluid into the mouth, but not so much as to make it unsafe. The preferred pressure is between 35 to 50 kPa or (5 to 7.25 psi), although greater pressures are also acceptable as long as the container and all components are sized to contain the elevated pressures. Lower pressure is also acceptable, although that may lead to lower flow volumes.

Figure 9:
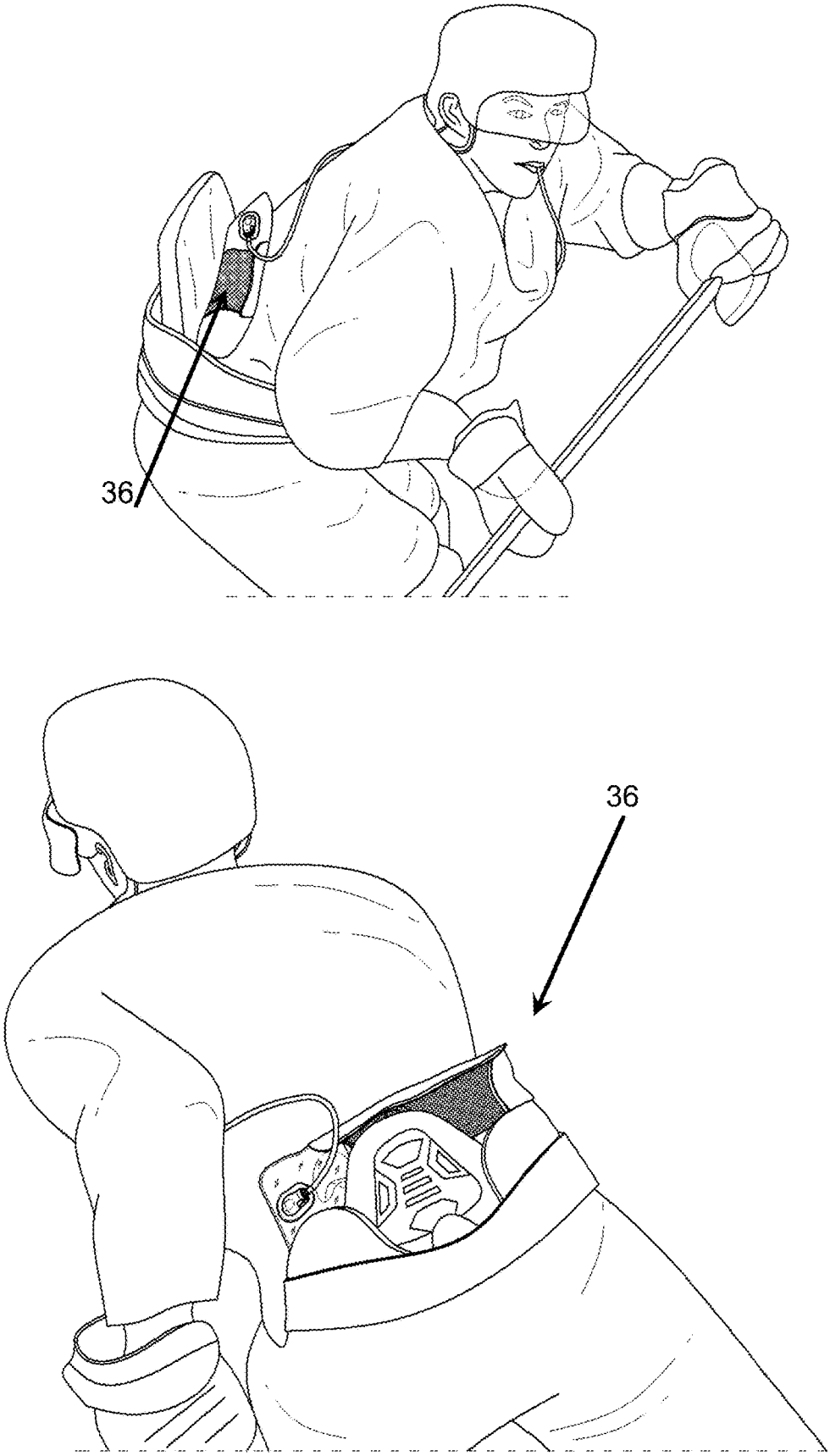
FIG. 9 is a drawing of how the canister shown in FIG. 6 would fit on the body of a hockey player.

Bag 36 is preferably sized so that it fits on a human's body strapped around the waist and anchored by the sports players' pants (see FIG. 9). In this configuration, bag 36 fits around the players back and can add extra protection against impact from the rear.

Figure 8:
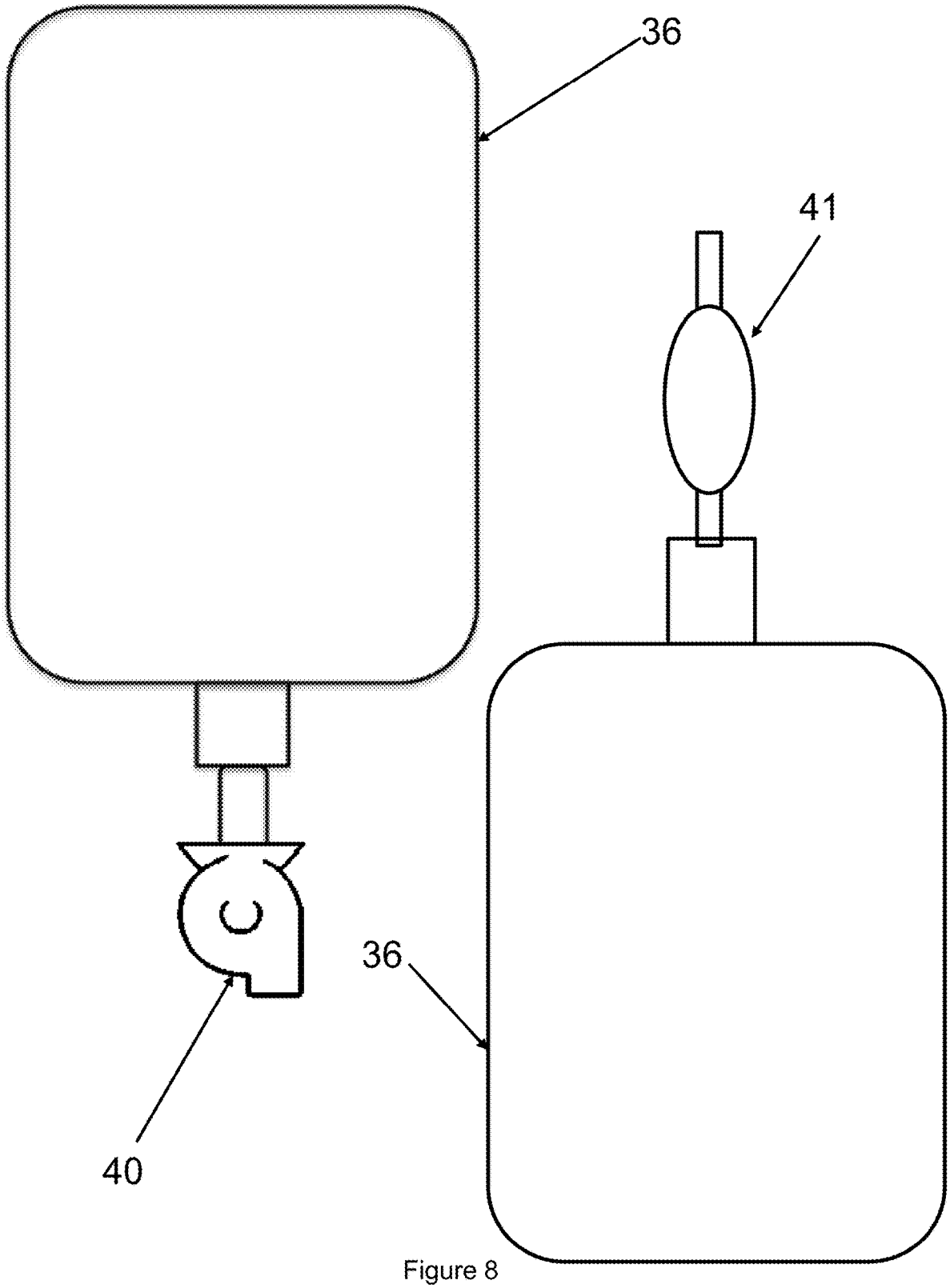
FIG. 8 are plan and perspective views of a bag or canister that are pressurized by a hand pump or a motorized pump.

Fluid can be delivered from bag 36 or any other suitable container by a motorized pump 40 (see FIG. 8). In this configuration, the valve 20 can be replaced by a tongue operated switch. The tongue operated switch may also be combined with suitable wiring and power source to activate motorized pump 40. The connection between the switch and motorized pump 40 may also include an electronic controller, wireless signal communication, and other suitable means for activating fluid delivery via control from the user's mouth.

Bag 36 can also be pressurized by the use of a mechanical pump 41 (see FIG. 8) that can be operated by the hand or any other suitable body part.

Figure 5:
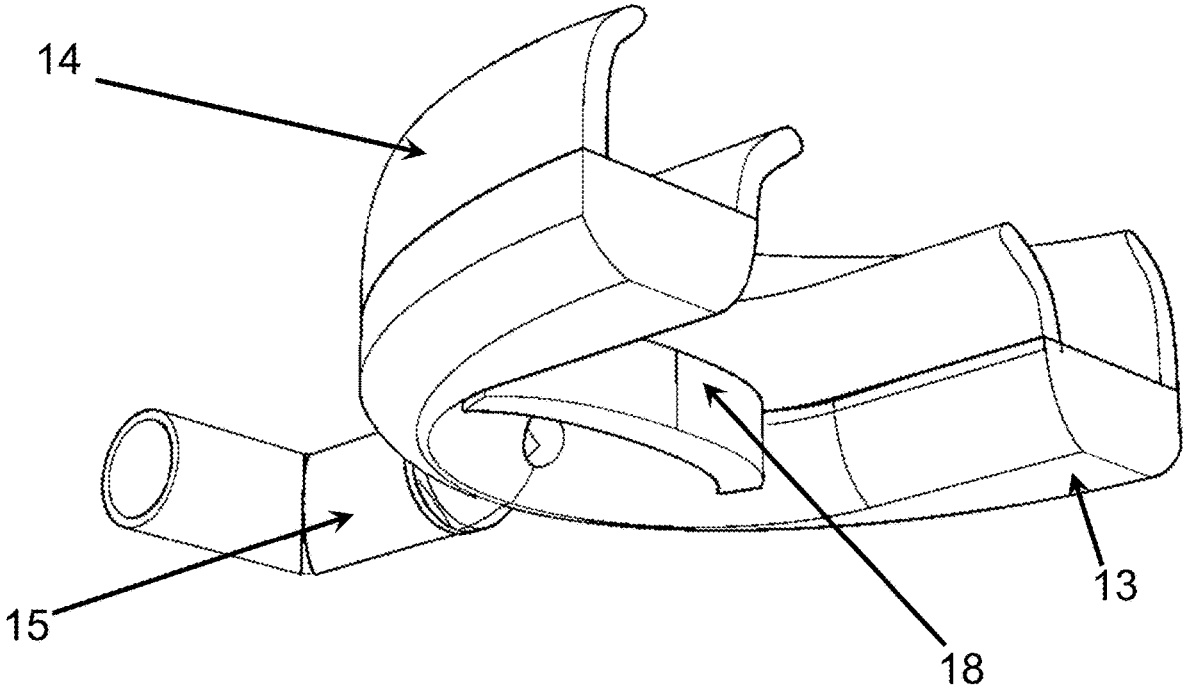
FIG. 5 is a drawing of the mouthguard component in perspective view from the bottom with alternative configurations for tubular portion 15.
Figure 5:
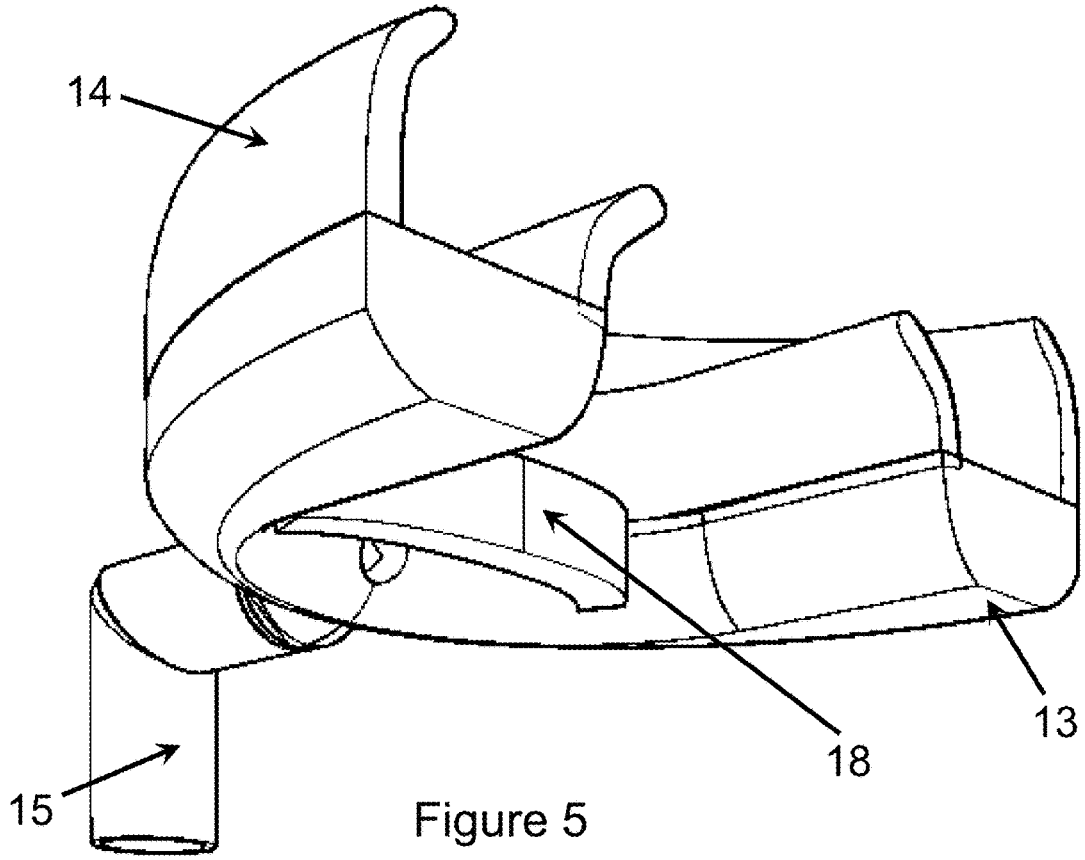

In an alternative embodiment, tubular portion 15 can be configured such that it is bent horizontally or vertically, or in any direction (see FIG. 5).

The foregoing description of the subject matter has been provided for illustration and description purposes only. The description is not intended to be exhaustive or to limit the subject matter to the only the form disclosed above. Other modifications and variations may be possible in view of the above teachings. The preferred embodiments were selected and described in order to best explain the principles of the invention and its application, and to enable others skilled in the art to make use of the invention in the various embodiments and modifications as may be suitable for their use. The appended claims are intended to include other alternative embodiments that may be suitable for the intended use, except as limited by the prior art.

What is claimed is:

1. A mouthguard protective component comprising:

a mouthpiece element dimensioned to cradle and protect a user's teeth;

a tubular portion for connecting the mouthpiece element with a fluid reservoir fillable with a drinkable fluid;

a valve moveable between a closed position and an open position by pressure applied by the user's tongue, wherein the fluid from the fluid reservoir is received into the user's mouth when the valve is moved to the open position, wherein the component further comprises a spring that is biased to move the valve to the closed position, thereby preventing the flow of fluid from the fluid reservoir.

2. The mouthguard protective component according to claim 1, wherein the spring is arc-shaped.

3. The mouthguard protective component according to claim 2, wherein the valve includes:

an elongated shaft component, an occluder component extending from a first end of the shaft component, and a retaining element extending from a second end of the shaft component, the retaining element maintaining the valve affixed to the spring.

4. A mouthguard protective component comprising:

a mouthpiece element dimensioned to cradle and protect a user's teeth;

a tubular portion for connecting the mouthpiece element with a fluid reservoir fillable with a drinkable fluid:

a valve moveable between a closed position and an open position by pressure applied by the user's tongue, wherein the fluid from the fluid reservoir is received into the user's mouth when the valve is moved to the open position, wherein the component further comprises a fitting located in the tubular portion, the fitting enabling connection to the fluid reservoir via a delivery tube, and wherein the component further comprises a clamping ring for retaining fitting in the tubular portion.

* * * * *